US006203373B1

(12) United States Patent
Lin

(10) Patent No.: US 6,203,373 B1
(45) Date of Patent: Mar. 20, 2001

(54) SHIELDED ELECTRICAL CONNECTOR

(75) Inventor: Cheng Te Lin, Taipei Heien (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/289,318

(22) Filed: Apr. 9, 1999

(30) Foreign Application Priority Data

Apr. 9, 1998 (TW) ..... 87205315

(51) Int. Cl.[7] ..... H01R 13/648
(52) U.S. Cl. ..... 439/607
(58) Field of Search ..... 439/607–610, 439/567, 79

(56) References Cited

U.S. PATENT DOCUMENTS

| | | | | |
|---|---|---|---|---|
| 5,094,627 | | 3/1992 | Uekido | 439/610 |
| 5,288,248 | | 2/1994 | Chen | 439/609 |
| 5,637,015 | | 6/1997 | Tan et al. | 439/607 |
| 5,702,271 | | 12/1997 | Steinman | 439/676 |
| 5,919,062 | * | 7/1999 | Wu | 439/607 |
| 5,980,320 | * | 11/1999 | Slack et al. | 439/607 |
| 5,984,726 | * | 11/1999 | Wu | 439/607 |
| 6,012,948 | * | 1/2000 | Wu | 439/567 |

FOREIGN PATENT DOCUMENTS

| | | | |
|---|---|---|---|
| 296 02 268 U1 | 11/1996 | (DE) | H01R/23/68 |
| 8-222324 | 8/1986 | (JP) | H01R/13/648 |
| 86200240 | 1/1997 | (TW) | H01R/13/648 |

* cited by examiner

*Primary Examiner*—Khiem Nguyen
(74) *Attorney, Agent, or Firm*—Robert J. Zeitler

(57) ABSTRACT

A shielded electrical connector includes a dielectric housing having a front mating end for interfacing with a complementary mating connector. A plurality of terminals are mounted on the housing and include contact portions for engaging appropriate terminals of the mating connector. First and second shields of sheet metal material substantially surround the housing. The first shield includes at least one clamping arm projecting therefrom. The second shield includes a hole for receiving the clamping arm of the first shield. The clamping arm is inserted through the hole and is bent into engagement with the second shield to hold the shields together about the housing.

13 Claims, 9 Drawing Sheets

SHIELDED ELECTRICAL CONNECTOR

FIELD OF THE INVENTION

This invention generally relates to the art of electrical connectors and, particularly, to connectors which are shielded against ingress and egress of electromagnetic and radio frequency interferences.

BACKGROUND OF THE INVENTION

Electrical circuitry often is provided with protection from electromagnetic interference (EMI) and radio frequency interference (RFI) emanating from or entering the system. Although EMI and RFI now are often used interchangeably, EMI has been used to connote energy occurring anywhere in the electromagnetic spectrum and RFI has been limited at times to interference in the radio communication band. EMI energy can be generated outside as well as inside the system. External EMI energy can interfere with the operation of electronic equipment within the system, while internal EMI energy can create "cross talk" and "noise" which can cause erroneous data transmission.

Electrical connectors are particularly prone to disruptions from EMI energy because of the numerous contact areas and openings for electrical terminals and cables. A typical electrical connector includes a dielectric housing mounting a plurality of conductive terminals. The housing may have a forward mating section. In order to protect the connector from disruptions caused by EMI energy, shields are provided about the dielectric housing and, particularly, the mating section thereof. Such shields often are fabricated of stamped and formed conductive sheet metal material. The sheet material is stamped and then formed or folded into an enclosure for the connector housing. One of the problems with such shields is that they often are made of multiple components which cause EMI "leakage" and the components are not held together by sufficiently strong engaging means. The present invention is directed to solving these problems in a multi-component shield which is simple and inexpensive to manufacture and assemble.

SUMMARY OF THE INVENTION

An object, therefore, of the invention is to provide a new and improved shielded electrical connector of the character described.

In the exemplary embodiment of the invention, the shielded connector includes a dielectric housing having a front mating end for interfacing with a complementary mating connector. A plurality of terminals are mounted on the housing and include contact portions for engaging appropriate terminals of the mating connector. First and second shields of sheet metal material substantially surround the housing. The first shield includes a clamping arm projecting therefrom. The second shield includes a hole for receiving the clamping arm of the first shield. The clamping arm of the first shield is inserted through the hole in the second shield and is bent into engagement with the second shield to hold the shields together about the housing.

As disclosed herein, the housing includes a rear end, a top wall and opposite side walls. The first shield is a main shield mounted on the housing about at least the top wall and opposite side walls thereof. A pair of the clamping arms project rearwardly from opposite sides of the main shield. The second shield is a rear shield about the rear end of the housing and includes a pair of the holes for receiving the clamping arms of the first shield.

Other features of the invention include the rear shield having recessed areas into which the clamping arms are bent. The rear shield is formed by a rear wall and side flanges projecting forwardly from the rear wall overlapping the opposite sides of the main shield. The holes in the rear shield are located at the junctures of the rear wall and the side flanges thereof.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
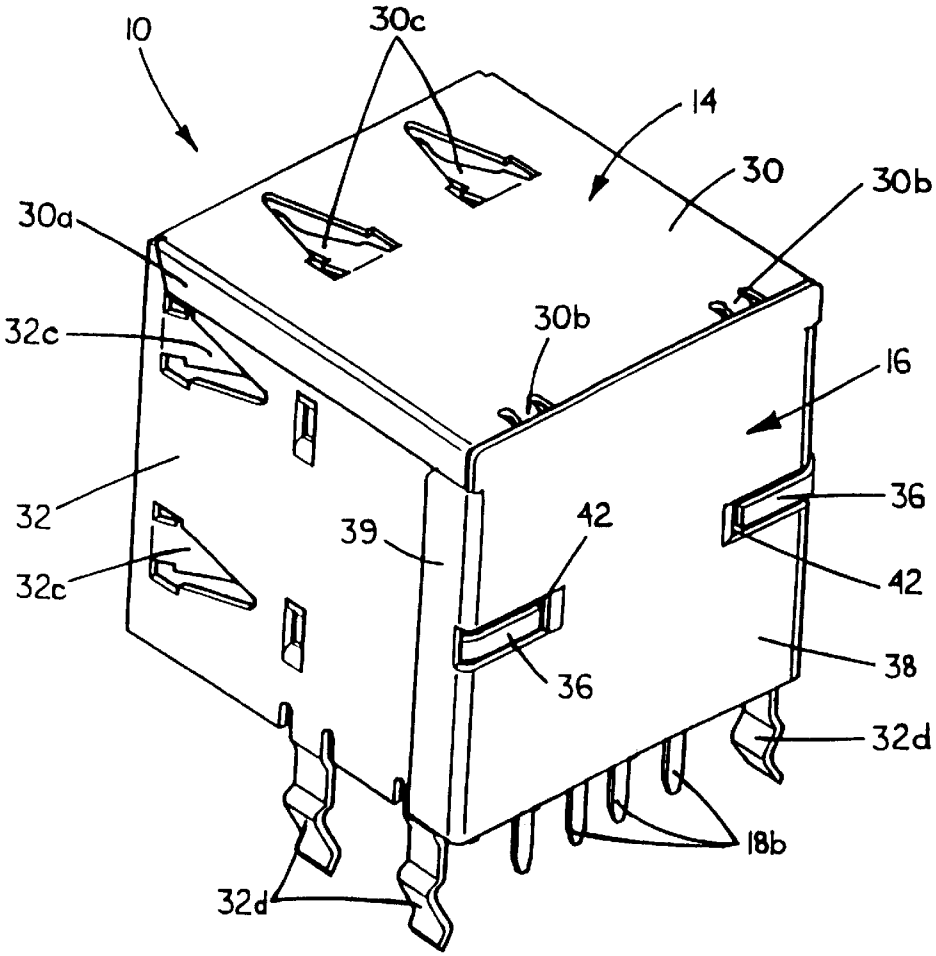
FIG. 1 is a rear perspective view of one embodiment of a shielded electrical connector incorporating the concepts of the invention.
Figure 2:
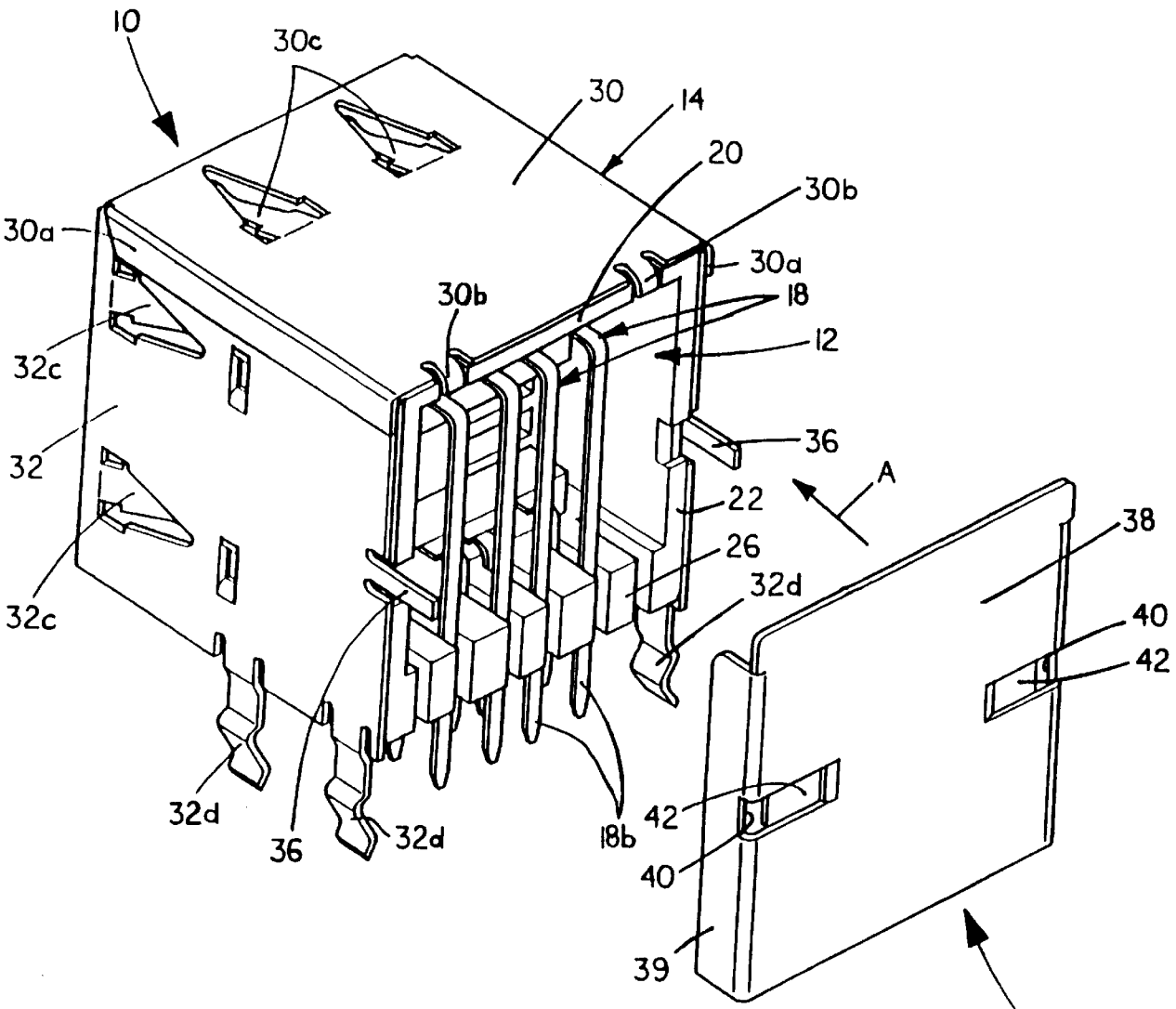
FIG. 2 is a view similar to that of FIG. 2, with the rear shield removed to facilitate the illustration.
Figure 3:
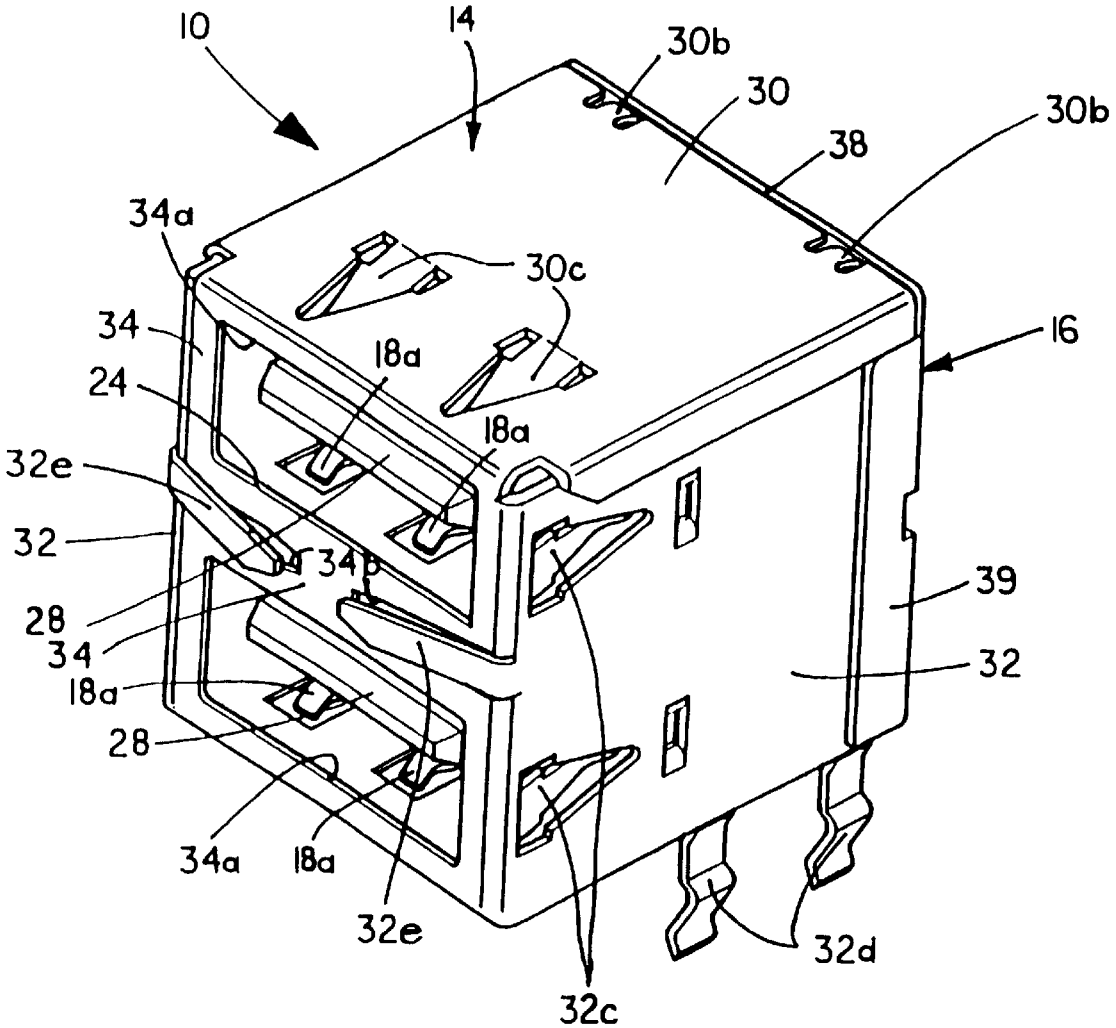
FIG. 3 is a front perspective view of the connector of FIG. 1.

Referring to the drawings in greater detail, and first to FIGS. 1–3, a first embodiment of a shielded electrical connector according to the invention is generally designated 10. The connector includes a dielectric housing, generally designated 12 (FIG. 2), substantially surrounded by a shield means which includes a first or main shield, generally designated 14, and a second or rear shield, generally designated 16. A plurality of terminals, generally designated 18 (FIG. 2), are mounted on housing 12 and include contact portions 18*a* (FIG. 3) for engaging appropriate terminals of a complementary mating connector.

More particularly, housing 12 is a one-piece structure unitarily molded of dielectric material such as plastic or the like. As best seen in FIG. 2, the housing includes a top wall 20 and opposite side walls 22. The housing defines a front mating end 24 of the connector as seen in FIG. 3, and the housing has a rear end 26 as seen in FIG. 2. Finally, the housing includes a pair of generally parallel plug boards or terminal platforms 28 (FIG. 3).

Terminals 18 include tail portions 18*b* depending from the housing for insertion into appropriate holes printed circuit board and for connection, as by soldering, to appropriate circuit traces on the board and/or in the holes. The terminals are bent at right angles as best seen in FIG. 2, so that contact portions 18*a* of the terminals extend forwardly into the housing toward the front mating end 24 thereof.

First or main shield 14 is stamped and formed of sheet metal material and includes a top plate 30 and side plates 32 positioned over top wall 20 and side walls 22, respectively, of housing 12. Side flanges 30*a* of the top plate overlap the top edges of side plates 32. A pair of tabs 30*b* at the rear of the top plate are bent into engagement within recesses at the rear edge of top wall 20 of the housing. A pair of contact tabs 30*c* of top plate 30 and 32*c* of side plates 32 are bent inwardly near the front mating end of the connector for engaging an appropriate shield of the complementary mating connector. Each side plate 32 also has a pair of mounting legs 32*d* for insertion into appropriate mounting holes in the printed circuit board. The mounting legs also can serve as grounding legs for engaging appropriate ground circuits on the board and/or in the mounting holes in the board.

Referring specifically to FIG. 3, main shield 14 also has a front plate 34 formed with a pair of openings or receptacles 34*a* for receiving plug portions of the complementary mating connector. A pair of grounding arms 32*e* project forwardly from the front edges of side plates 32 and are bent in front of front plate 34 in registry with a pair of cutouts 34*b* in the front plate. Arms 32*e* form grounding fingers at the front of connector 10 for engaging the shield of the complementary mating connector or for engaging a housing within which the connector is mounted, as will be seen hereinafter. The arms or grounding fingers can be displaced into cutouts 34*b* in front plate 34.

As best seen in FIG. 2, a pair of clamping arms 36 project rearwardly of front shield 14. Specifically, the clamping arms project rearwardly from the rear edges of side plates 32 of the main shield.

Rear shield 16 includes a rear plate or wall 38 with a pair of side flanges 39 projecting forwardly of the rear plate in overlapping relationship along the rear edges of side plates 32 of the front shield. A pair of holes 40 are formed in rear shield 16 at the junctures between rear plate 38 and side flanges 39. The rear plate includes recessed portions 42 which form recessed areas for receiving clamping arms 36.

More particularly, after front shield 14 is assembled about housing 12 as described above, rear shield 16 is assembled in the direction of arrow "A" (FIG. 2). During assembly, clamping arms 36 of front shield 14 are inserted through holes 40 in rear shield 16. Once the rear shield is positioned flush with rear end 26 of housing 12, clamping arms 36 are bent inwardly as shown in FIG. 1 into recessed areas 42 of rear plate 38 of the rear shield. The clamping arms therefore are flush with the rear plate of the rear shield.

Figure 4:
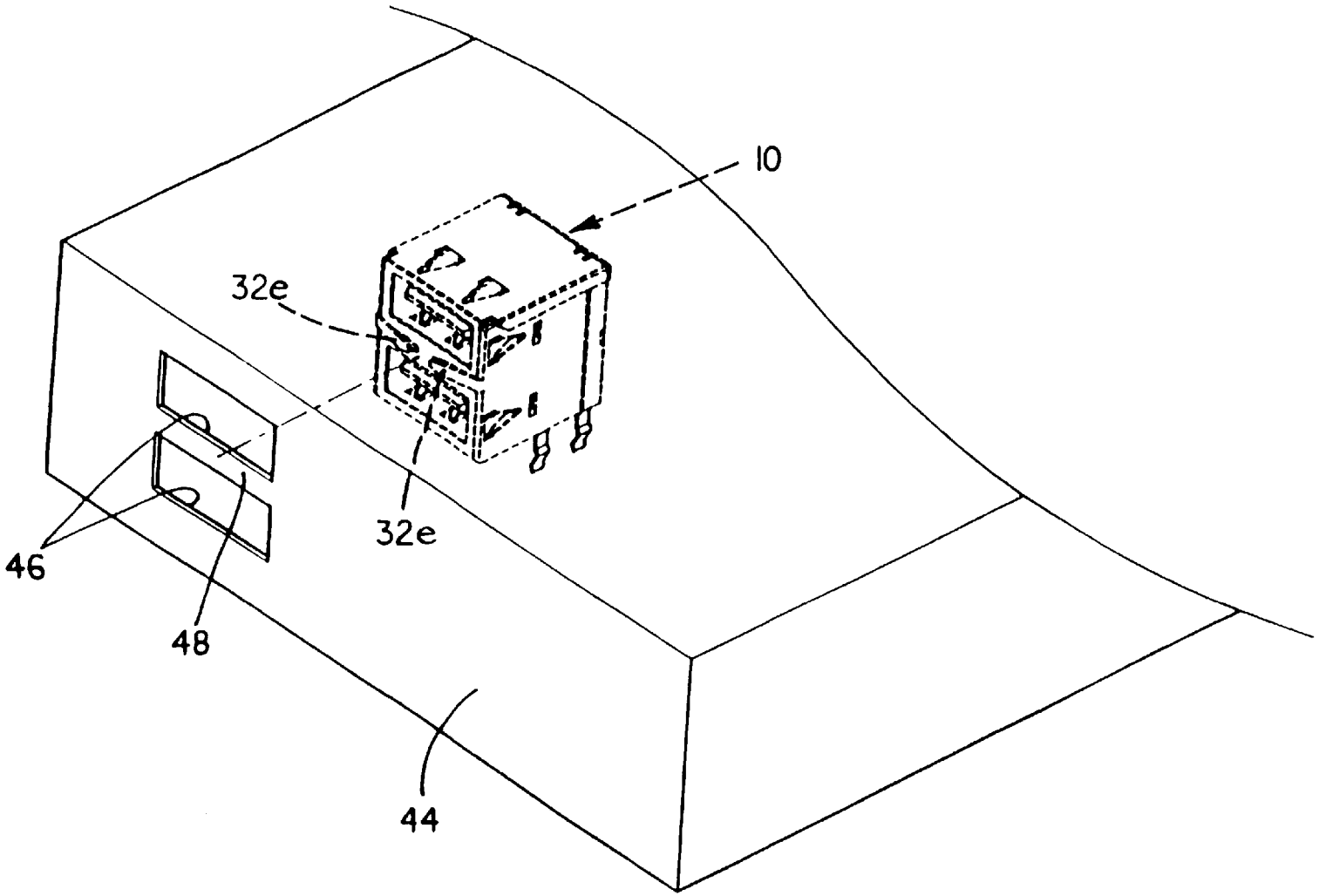
FIG. 4 is a fragmented perspective view o a housing within which the connector of FIGS. 1–3 can be mounted.

FIG. 4 simply shows one application of shielded connector 10 mounted within a housing 44 which may be a computer housing. A mating connector-receiving hole 46 is divided by a transverse strip 48 which is engaged by grounding fingers 32*e* (FIG. 3) of front shield 14 of the connector. The split hole 46 is aligned with receptacles 34*a* (FIG. 3) in front shield 14 about housing 12 of connector 10.

Figure 5:
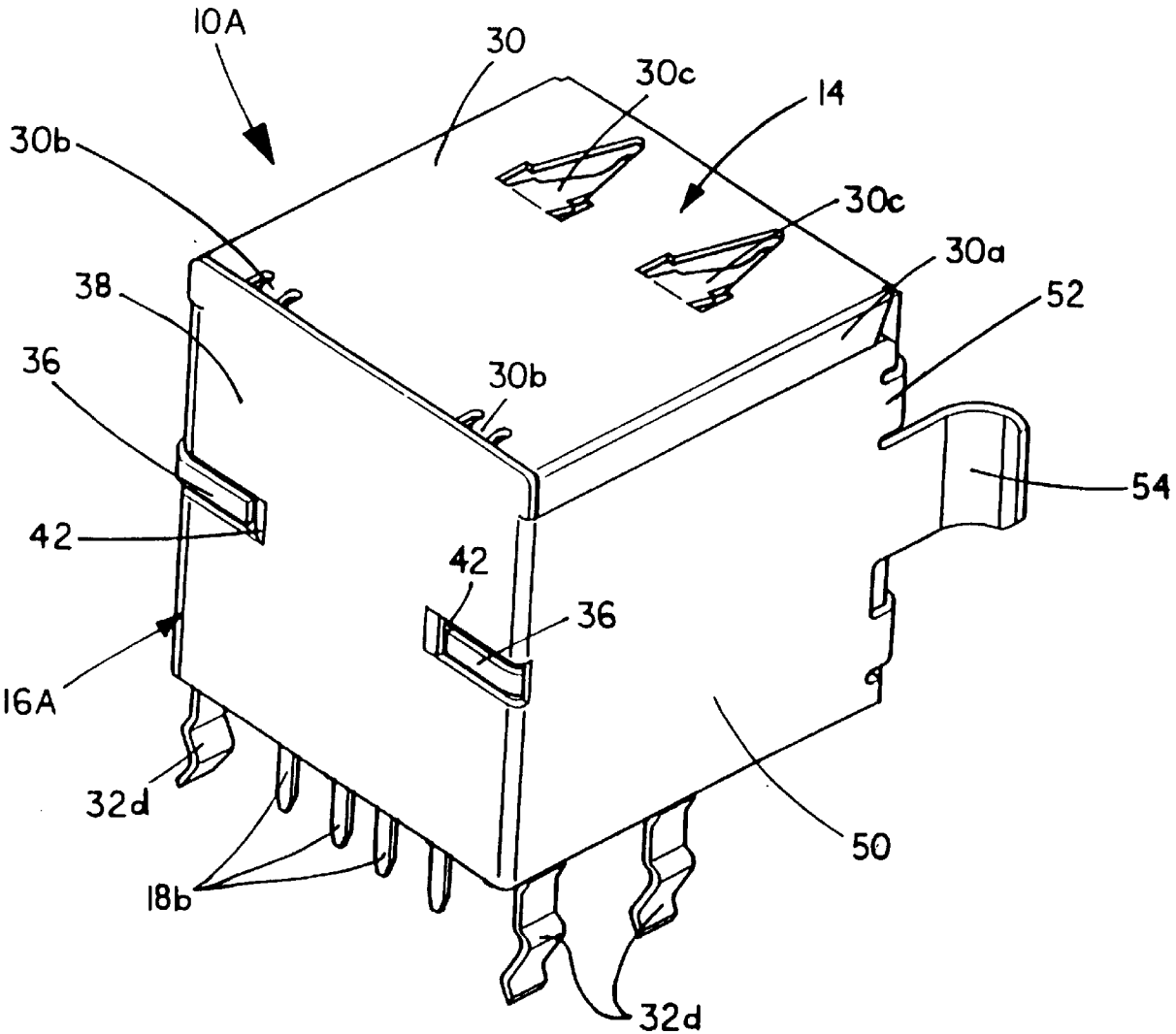
FIG. 5 is a view similar to that of FIG. 1, but of a second embodiment of the invention.
Figure 6:
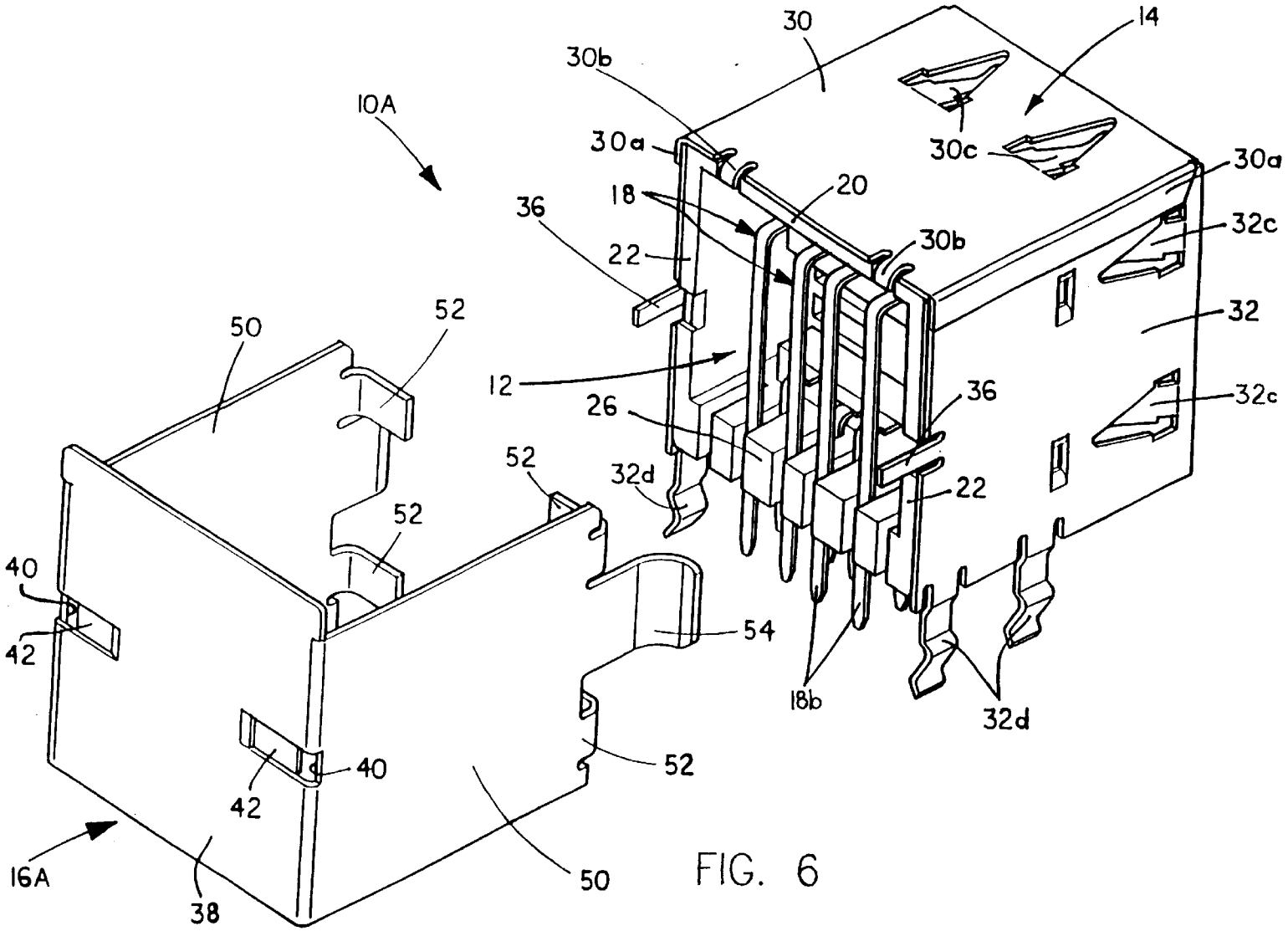
FIG. 6 is a view similar to that of FIG. 5, but with the rear shield removed.
Figure 7:
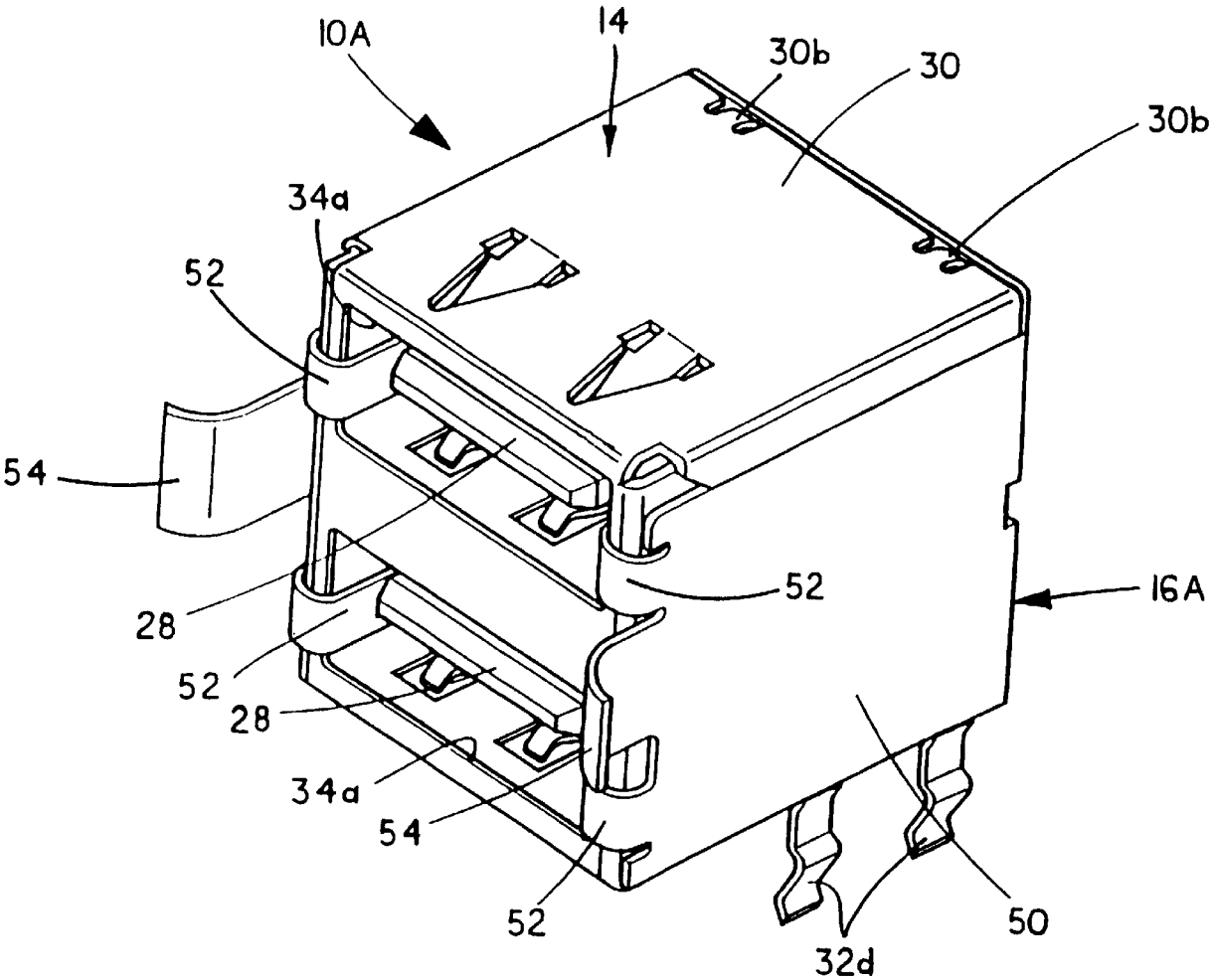
FIG. 7 is a front perspective view of the connector of FIG. 5.

FIGS. 5–7 show a second embodiment of a shielded electrical connector, generally designated 10A, incorporating the concepts of the invention. Connector 10A is very similar to connector 10 except for the configuration of a rear shield 16A of connector 10A. Therefore, like numerals have been applied in FIGS. 5–7 corresponding to like components described above in relation to connector 10 in FIGS. 1–3. In fact, housing 12 and the front or main shield 14 are identical and the structure of the housing and the main shield will not be repeated in relation to connector 10A of FIGS. 5–7.

More particularly, in the second embodiment of connector 10A, rear shield 16A includes a pair of side plates or walls 50 which replace flanges 39 of rear shield 16 in first connector 10. Side plates 50 extend all the way forwardly to the front of the connector and include tabs 52 which are bent inwardly into receptacles 34*a* in front plate 34 of main shield 14. In addition, a pair of outwardly flared grounding fingers 54 also project forwardly of side plates 50 of rear shield 16A.

Otherwise, main shield 14 of second connector 10A includes clamping arms 36 which are inserted into holes 40 in rear shield 16A and are bent into recessed areas 42 of the rear shield.

Figure 8:
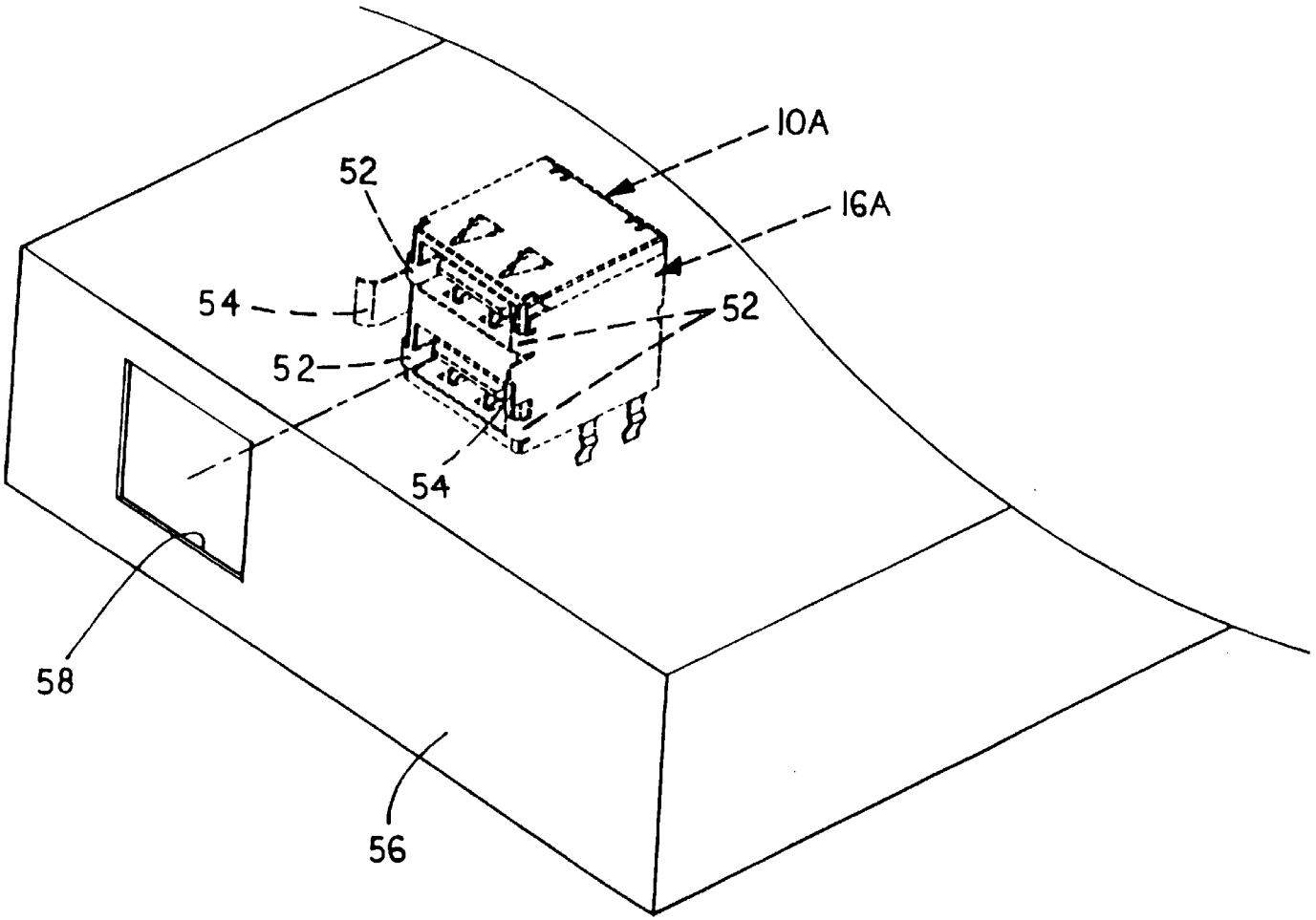
FIG. 8 is a view similar to that of FIG. 4, but showing the connector of FIG. 5.

FIG. 8 shows second connector 10A mounted within a housing 56 having a single hole 58 instead of the split hole 46 (FIG. 4) for first connector 10. With the single hole 58, grounding fingers 54 of rear shield 16A of the second connector engage the inside of the housing at the outsides of hole 58.

Figure 9:
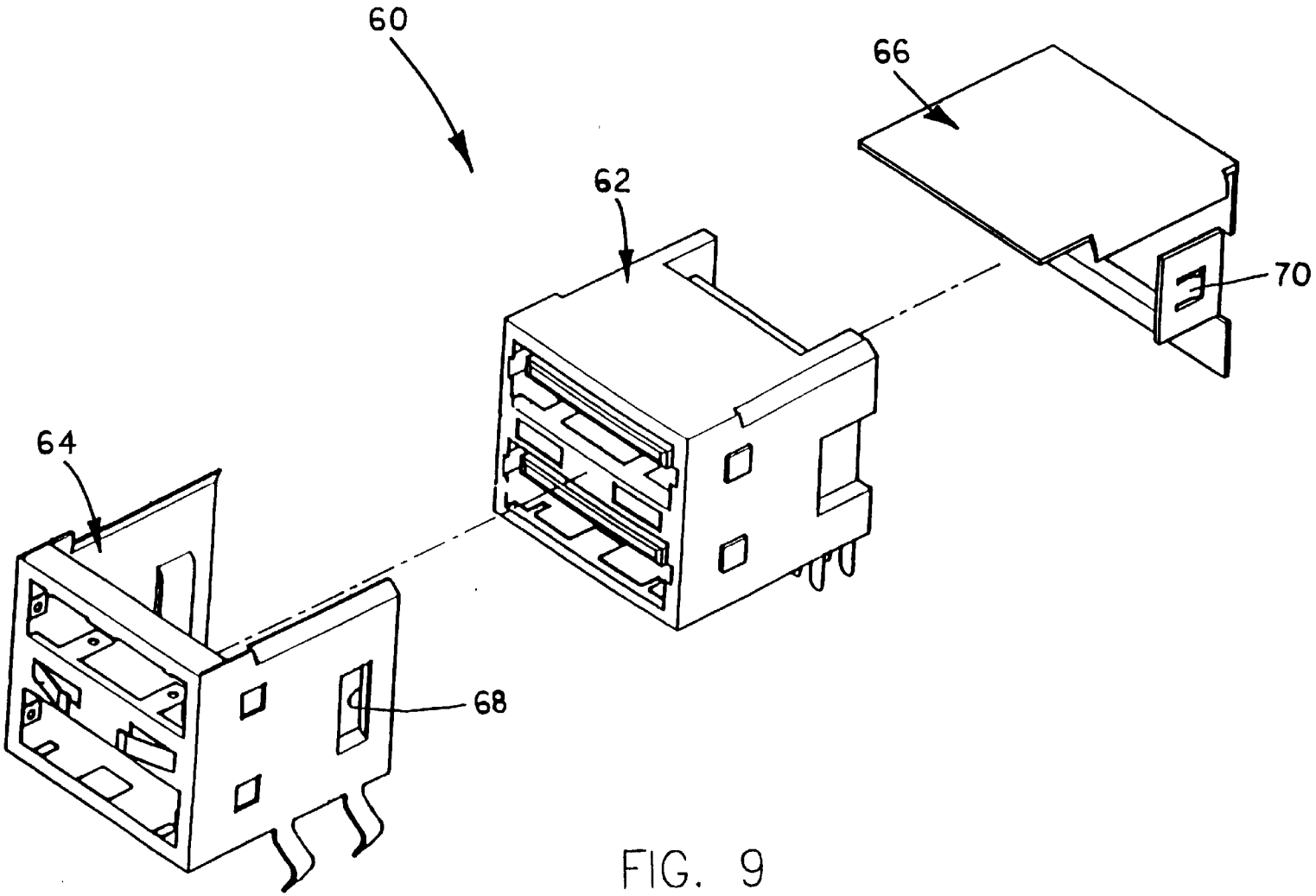
FIG. 9 (PRIOR ART)
FIG. 9 is an exploded perspective view of a shielded connector according to the prior art.

FIG. 9 shows a shielded electrical connector, generally designated 60, according to the prior art. The connector includes a dielectric housing, generally designated 62, a front shield, generally designated 64, and a rear shield, generally designated 66. The shields are mounted about the housing by means of a pair of latching recesses 68 in the front shield and a pair of latching tabs 70 or tre rear shield.

It will be understood that the invention may he embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A shielded electrical connector, comprising:

a dielectric housing having a front mating end for interfacing with a complementary mating connector, a rear end, a top wall and opposite side walls;

a plurality of terminals mounted on the housing and including contact portions for engaging appropriate terminals of the mating connector;

a main shield mounted on the housing about at least the top wall and opposite side walls thereof, and including a pair of clamping arms projecting rearwardly from opposite sides of the main shield; and a rear shield about the rear end of the housing and including a pair of holes for receiving the clamping arms of the main shield, whereby the clamping arms of the main shield can be inserted through the holes in the rear shield and bent into engagement with the rear shield to hold the shields together about the housing.

2. The shielded electrical connector of claim 1 wherein at least the main shield is fabricated of sheet metal material.

3. The shielded electrical connector of claim 2 wherein the rear shield is fabricated of sheet metal material and includes recessed areas into which the clamping arms are bent.

4. The shielded electrical connector of claim 1 wherein said rear shield includes a rear wall and side flanges projecting forwardly from the rear wall overlapping the opposite sides of the main shield.

5. The shielded electrical connector of claim 4 wherein said holes are located at the junctures of the rear wall and the side flanges of the rear shield.

6. The shielded electrical connector of claim 5 wherein at least the main shield is fabricated of sheet metal material.

7. The shielded electrical connector of claim 6 wherein the rear shield is fabricated of sheet metal material and includes recessed areas in the rear wall into which the clamping arms are bent.

8. The shielded electrical connector of claim 1 wherein said rear shield includes a rear wall and side walls projecting forwardly from the rear wall overlapping the opposite sides of the main shield and including grounding fingers at the front mating end of the connector housing.

9. A shielded electrical connector, comprising:

a dielectric housing having a front mating end for interfacing with a complementary mating connector;

a plurality of terminals mounted on the housing and including contact portions for engaging appropriate terminals of the mating connector;

first and second shields of sheet metal material substantially surrounding the housing, said first shield including a clamping arm projecting therefrom, and said second shield including a hole for receiving the clamping arm of the first shield, whereby the clamping arm of the first shield can be inserted through the hole in the second shield and bent into engagement with the second shield to hold the shields together about the housing.

10. The shielded electrical connector of claim 9 wherein said second shield includes a recessed area into which the clamping arm is bent.

11. The shielded electrical connector of claim 9 wherein said second shield includes a flange projecting from a wall of the second shield in overlapping relationship at an edge of the first shield, said clamping arm projects from said edge of the first shield, and said hole is located at a juncture of the wall and the flange of the second shield.

12. The shielded electrical connector of claim 9, including a plurality of said clamping arms of the first shield and a corresponding plurality of holes of the second shield at least at opposite sides of the shields.

13. The shielded electrical connector of claim 9 wherein said second shield includes a rear wall and side walls projecting forwardly from the rear wall and including at least one grounding finger at the front mating end of the connector housing.

* * * * *